US005346283A

United States Patent [19]

Steininger et al.

[11] Patent Number: 5,346,283

[45] Date of Patent: Sep. 13, 1994

[54] DENTAL PATIENT CHAIR WITH AN ADJUSTABLE HEADREST

[75] Inventors: Ulrich Steininger, Darmstadt; Klaus Stoeckl, Bensheim; Tilman Phleps, Lorsch, all of Fed. Rep. of Germany

[73] Assignee: Siemens Aktiengesellschaft, Munich, Fed. Rep. of Germany

[21] Appl. No.: 883,395

[22] Filed: May 15, 1992

[30] Foreign Application Priority Data

Jun. 10, 1991 [EP] European Pat. Off. ..... 91109500.8

[51] Int. Cl.[5] ..... A47C 7/38

[52] U.S. Cl. ..... 297/408; 297/61; 297/284.1; 297/391

[58] Field of Search ..... 297/408–410, 297/61, 284.1, 391

[56] References Cited

U.S. PATENT DOCUMENTS

| | | | |
|---|---|---|---|
| 3,603,642 | 9/1971 | Laessker | 297/408 |
| 3,929,374 | 12/1975 | Hogan et al. | 297/61 |
| 3,936,091 | 2/1976 | Rabinowitz | 297/408 X |
| 4,014,594 | 3/1977 | Hain | 297/408 |
| 4,215,680 | 8/1980 | Okuda | 297/61 X |
| 4,335,920 | 6/1982 | Hirth | 297/408 |
| 4,515,406 | 5/1985 | Fujiyama et al. | 297/409 |
| 4,674,797 | 6/1987 | Tateyama | 297/408 |
| 4,830,434 | 5/1989 | Ishida et al. | 297/408 |
| 4,840,429 | 6/1989 | Stöckl | 297/409 |
| 4,923,250 | 5/1990 | Hattori | 297/61 X |
| 5,011,225 | 4/1991 | Nemoto | 297/410 X |
| 5,015,035 | 5/1991 | Stoeckl et al. | 297/345 |
| 5,502,754 | 10/1991 | Chinomi | 297/408 |

FOREIGN PATENT DOCUMENTS

| | | | |
|---|---|---|---|
| 88957 | 9/1983 | European Pat. Off. | 297/61 |
| 2541506 | 3/1977 | Fed. Rep. of Germany . | |
| 3611282 | 10/1987 | Fed. Rep. of Germany . | |
| 1218541 | 1/1971 | United Kingdom . | |

*Primary Examiner*—Peter M. Cuomo
*Assistant Examiner*—Suzanne L. Dino
*Attorney, Agent, or Firm*—Hill, Steadman & Simpson

[57] ABSTRACT

A dental patient chair has an adjustable headrest on a headrest carrier. The headrest is pivotably hinged around a transverse first axis on a bracing member which, in turn, is adjustable in the longitudinal direction in the backrest. In addition, the headrest is connected by a linkage which is pivotably connected on a second axis offset from the first axis so that movement of the linkage causes tilting of the headrest. The linkage is shifted as the headrest carrier is extended and contracted.

10 Claims, 5 Drawing Sheets

DENTAL PATIENT CHAIR WITH AN ADJUSTABLE HEADREST

BACKGROUND OF THE INVENTION

The present invention is directed to a dental patient chair having an adjustable headrest that is pivotably hinged to a bracing member around a first transverse axis and the bracing member is adjustable in a longitudinal direction of the backrest, the headrest is pivotably connected to a link at an offset second axis, so that the first transverse axis forms a lever arm together with the second axis and an application of either tensile or compressive forces by an adjustment arrangement to the link causes a pivoting of the headrest.

Taking ergonomic perceptions into consideration, a design of a dental treatment chair occurs in view of adapting the motion sequence of the headrest of the dental treatment chair to the natural nodding motion that the head of a patient situated in the dental treatment chair executes when the head is brought into various treatment positions. This is particularly difficult to implement for the two extreme positions, namely the extreme "extension position" on the one hand, wherein the head and, thus, the headrest should be highly inclined in a backward direction in comparison to the backrest for an upper jaw treatment to give a direct view into the patient and, on the other hand, for the "prothetic position", wherein the head should be inclined forward to such an extent given an upright backrest position until, for instance, a horizontal occlusion plane is reached.

U.S. Pat. No. 4,515,406 discloses a design wherein a bracing carrying the head support is fashioned as a circularly curved, narrow plate that contains the center of a circle that lies approximately in the cervical vertebra joint of a patient sitting in the chair. The curved plate is guided in a slot held adjustably along the backrest and can be moved into and out of the carriage or, respectively, the backrest on the basis of a hydraulic drive.

Even though this design proves physiologically beneficial and allows a relatively narrow thin headrest shape, this arrangement has some disadvantages. Due to the brace member's guidance, the motion angle of the headrest is highly restricted. In addition, a relatively bulky mechanism is required in the upper backrest part. Given this design, every attempt to design the backrest thinner in this region, which would be inherently desirable in order to position the patient's head as low as possible in the fully reclining position, but to, nonetheless, have adequate freedom for the knees of the attending person, would lead to a further restriction of the kinematics in this design and, thus, the positioning possibilities for the patient's head. An additional disadvantage may be seen wherein the adaptation to relatively tall patients is only conditionally possible and extremely tall patients are lent no support in the neck region in this particular arrangement.

Another headrest which, also, is only adjustable within limits is disclosed in German OS 36 11 282. In this particular design, the two extreme positions recited at the outset can be only inadequately set. By contrast to the above-mentioned design wherein the headrest itself can be executed relatively flat and thin, the headrest in this particular design is constructed relatively thick because of the tilt mechanism provided therein, and this is disturbing in view of the optimally great freedom of legs or, respectively, knees that the attending person desires when the backrest is greatly inclined. An adaptation of the size of the patient is also only conditionally possible in this known design. Extremely tall patients, likewise, have no adequate support for the neck region.

U.S. Pat. No. 4,840,429, whose disclosure is incorporated herein by reference thereto and which claims priority from German Application 37 27 204, discloses another headrest design wherein the parallelogram-like linkage is hinged to the backrest or, respectively, to a carrier part held in the backrest. The pairs of articulations of this linkage form a four-bar mechanism having articulation spacings of different sizes. Whereas the pair of articulations having the smallest articulation space is arranged approximate to the backrest, the pair of articulations provided with the largest articulation spacing is arranged distal of the backrest. The pair of articulations distal from the backrest is formed by an articulated connection of the two articulated arms with the movable part of a straight-line mechanism provided in the longitudinal direction of the headrest. The one linkage arm is provided with a roller lever that is supported against a guideway which is rigidly secured in the housing of the headrest. The movable part is moved relative to the fixed part of the straight-line mechanism with a drive motor. Even though the two extreme positions mentioned in the beginning can be achieved rather well with this adjustment mechanism, the mechanism provided in the head support here has a relatively thick wall structure.

SUMMARY OF THE INVENTION

The object of the present invention is to provide a dental chair comprising a headrest that is pivotably hinged around a transverse axis on a bracing member which is adjustable in a longitudinal direction so that the dental chair does not have the aforementioned disadvantages. Thus, an optimally thin and flat headrest can be achieved and allows an optimum support of the patient's head in all treatment positions, whereby the motion sequence between the two, initially-cited extreme positions should be physiologically beneficial and should occur in accordance with the natural nodding motion of a patient's head during the adjustment thereof. In addition, a better support of not only the head, but also the back in the region of the upper spinal vertebra and cervical vertebra should be enabled, particularly given both taller and relatively short patients.

To accomplish these goals, the dental patient chair of the present invention comprises a headrest that is pivotably hinged around a first transverse axis of a bracing member, which is adjustable in a longitudinal direction of the backrest. The transverse axis forms a lever arm together with an articulated axis or second axis of a link hinged to the headrest and loadable with either a tensile or a compression force on the basis of the adjustment means and, thus, effects the pivotability of the headrest, whereas the link and the adjustment means are allocated to the headrest carrier that contains the bracing member and is adjustable vis-a-vis the backrest.

On the basis of the inventively proposed displacement of the adjustment mechanism for the head support into the head support carrier, particularly into the lower and middle sections of the head support carrier, the head support itself can be constructed extremely flat and, preferably, as a headrest shell. Particularly in the treatment positions having the recumbent patient, the attending person is, thus, given considerably more freedom in the knee region than previously.

A further proposal of subdividing the head support carrier into three sections including a base part, main carrier and bracing, as well as their arrangement yields the great advantage that the optimal support, in particular the upper portion of the back, is guaranteed, even given extremely tall patients. As a result of the gentle lowering and raising of the main carrier that is a quasi-part of the backrest, the movement of the upper spinal vertebra of the patient is co-involved into the overall head motion, and this is extremely advantageous because the movement of the head does not occur only from the region of the cervical vertebra.

The measures of the invention achieve the further advantage that the backrest, in its extreme position, roughly forms a straight line together with the headrest carrier, and this is advantageous for this treatment position. In the other treatment positions, by contrast, particularly in the initially-cited, other extreme position, such as the prothetic position, there is a clear gradient between the backrest and the main carrier that corresponds to the natural anatomical conditions given a relaxed, seated patient's posture better than the aforementioned straight line in the extended position.

The two tilting motions, for example of the headrest and that of the main carrier, proceed simultaneously and in the same direction, but at different speeds, as a result whereof a harmonic adjustment of the patient's head is achieved.

A compact, harmonically closed, external shape that is easy to clean and care for can be achieved by the matching of the headrest carrier with reference to the external contour of the backrest.

Other advantages and features of the invention will be readily apparent from the following description of the preferred embodiments, the drawings and claims.

DESCRIPTION OF THE PREFERRED EMBODIMENTS

Figure 1:
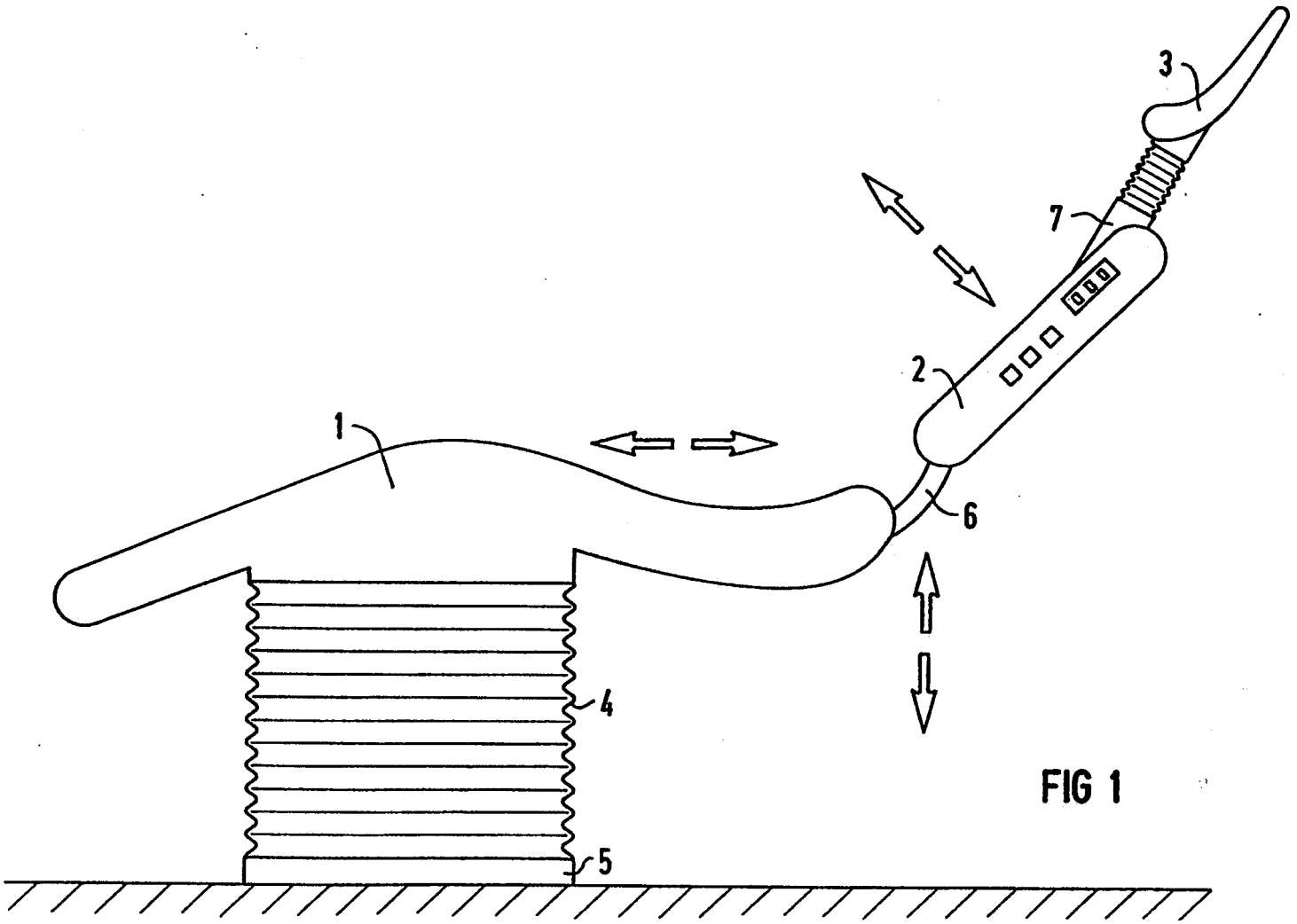
FIG. 1 is a side view of a dental chair in accordance with the present invention.

The principles of the present invention are particularly useful when incorporated in a dental chair of FIG. 1, which chair contains an upper chair part containing a chair seat 1, which is connected by a connecting element 6 to a backrest 2, which is connected by a headrest carrier 7 to a headrest 3, which are all arranged adjustable relative to one another with respect to a base chair part 5 in a known way on the basis of an adjustment mechanism (not shown) which is covered by an accordion bellows 4. An example of the adjustment mechanism for the seat 1 within the bellows 4 can be the mechanism described in U.S. Pat. No. 5,015,035, whose disclosure is incorporated herein by reference thereto. The adjustment possibilities recited herein are indicated by the arrows and are to be considered only by way of example. Thus, it is definitely possible to also arrange the backrest adjustable relative to the seat by the connecting element 6, which is correspondingly guided in the chair seat 1.

Figure 2:
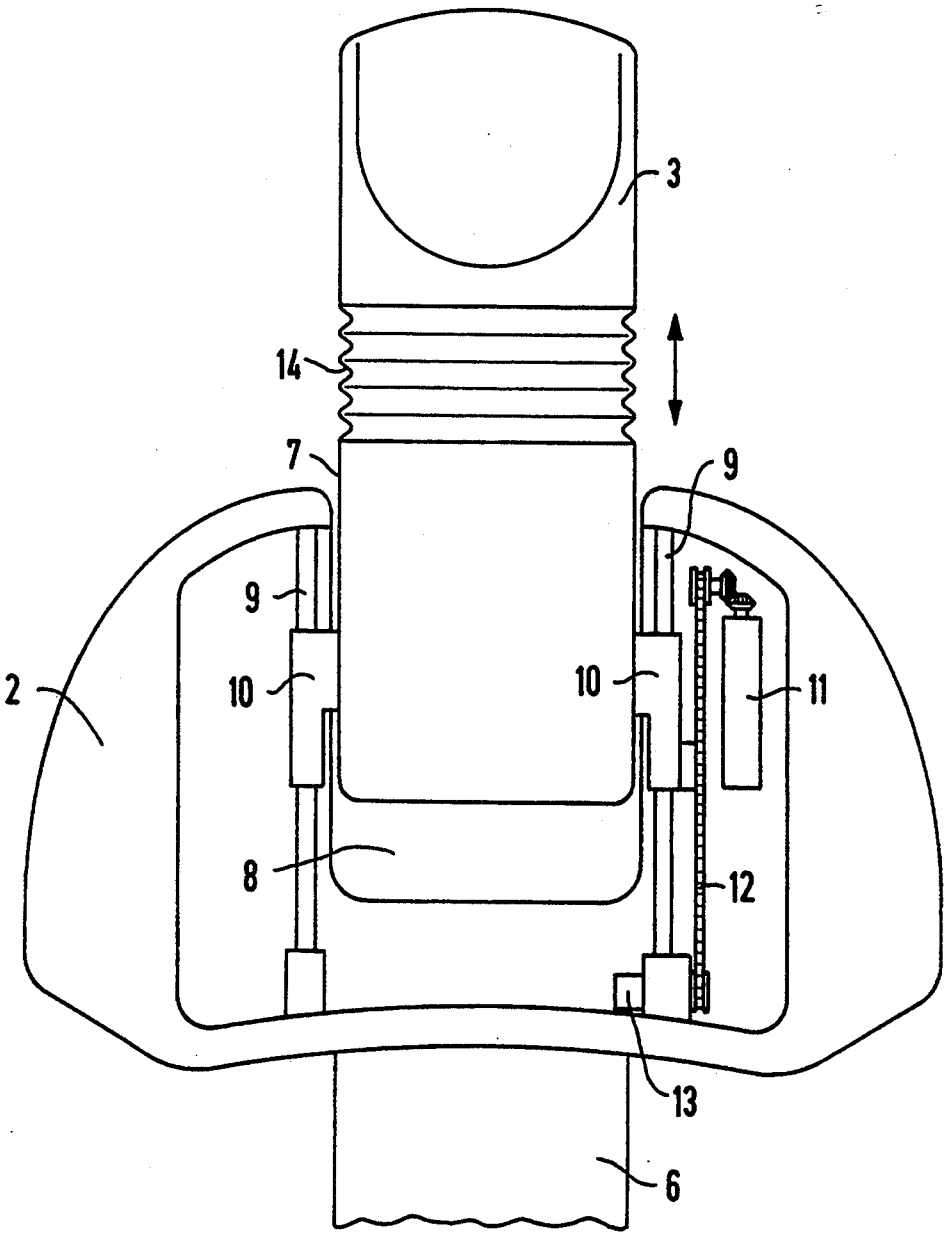
FIG. 2 is a plane view of a headrest and backrest of the patient chair in accordance with the present invention with the backrest cushions being removed.

As best illustrated in FIG. 2, the headrest 3 and the headrest carrier 7 have the same width and are arranged for longitudinal displacement in the backrest 2. To this end, the backrest 2 comprises a central cutout portion 8, which is opened toward the top, to which at least the lower part of the headrest carrier 7 is matched. In order to shift the headrest carrier 7 and the headrest 3 in the backrest 2, the backrest is provided with first means which include a pair of guide rods 9 which slidably receive guide bushings 10 that are secured to the headrest carrier 7. To shift the bushings 10 on the rods 9, a gear motor 11 is provided in the backrest 2 and drives a toothed belt 12, which is secured to one of the guide bushings 10. A position sensor 13 with which the exact position of the headrest carrier 7 with reference to the backrest 2 can be acquired, is provided and is also driven by the toothed belt 12. The articulation or pivoting of the headrest carrier 7 to the headrest 3 will be described in greater detail and is covered by an accordion bellows 14 that follows the outer contour of the headrest and headrest carrier and, thus, creates a harmonic transition that is easy to clean.

It should be pointed out that in this context, part of the headrest carrier 7 adjoining the accordion bellows 14 downwardly in the direction toward the backrest 2 has a cushion adapted to the backrest. As a result of this cushion, an optimum support of the upper spine and cervical vertebra of the patient is established, even in the extreme position that corresponds to extremely tall patients.

Figure 3:
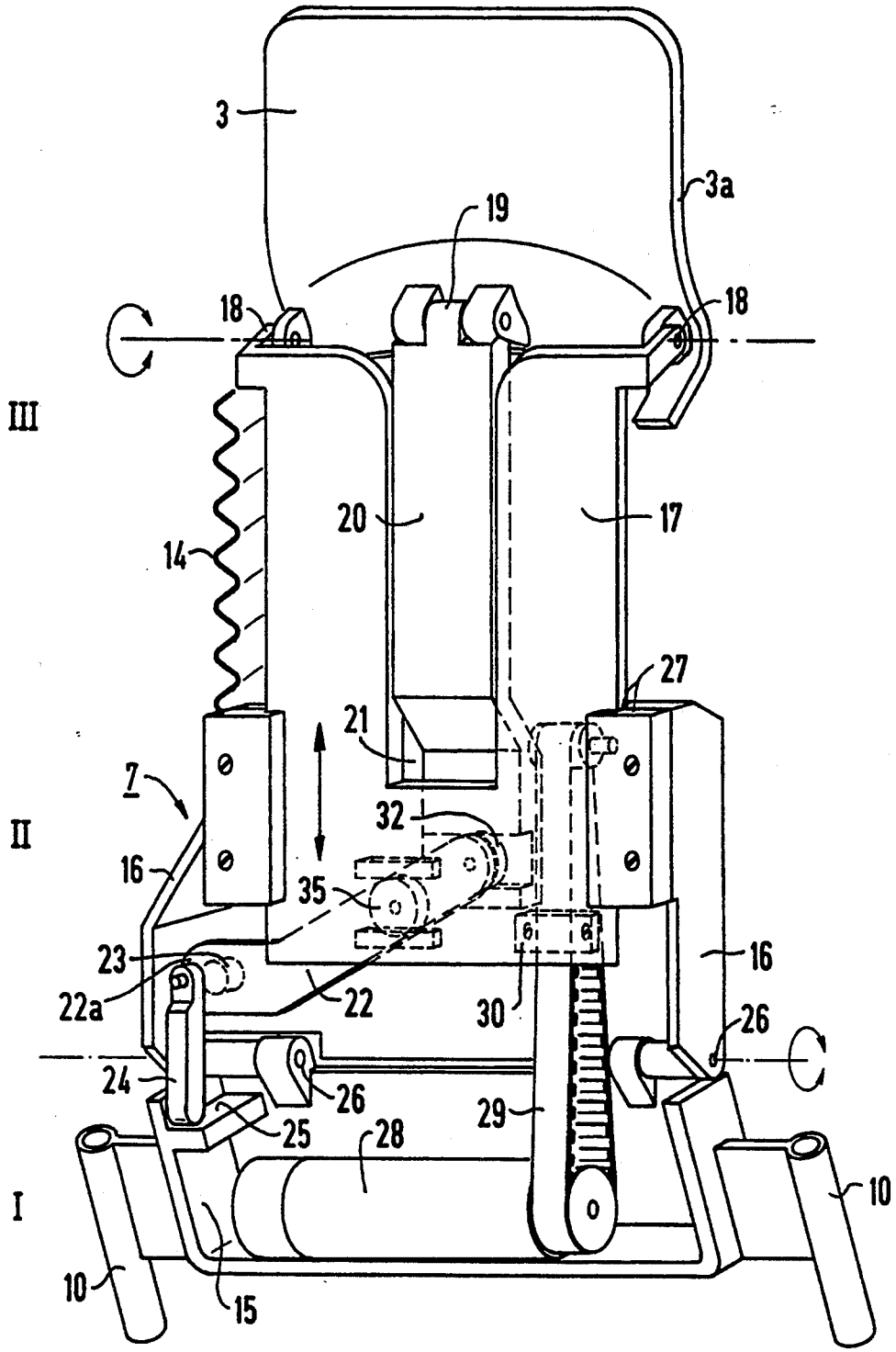
FIG. 3 is a rear view of the headrest adjustment mechanism with portions removed for purposes of illustration.

The headrest 3 and headrest carrier 7, as illustrated in FIG. 3, has the cladding portions removed. As illustrated, the headrest 3 contains an angled frame **3*a* that advantageously is a contour-emphasized shaped part and contains a shell-shaped depression for the head support of the patient. The headrest carrier 7 can be divided into three sections, including a lower portion or section I, a middle portion or section II, and an upper portion or section III. The lower section I contains a base part 15 that carries the two guide bushings 10. The middle section II contains the main carrier 16 and the upper section III contains a bracing member 17. The bracing member 17 is fashioned plate-shaped, wherein one upper end is fashioned in a fork-like manner and contains two bearing necks or projections that form a pivot bearing or first axis 18, around which the headrest 3 is pivotably mounted for rotation, as indicated by the arrow. An additional pivot or second axis 19 is arranged at approximately half the width of the headrest 3. A rod or link 20 is pivotably connected to the pivot bearing 19 and extends downward in a slot-like recess 21 that is between the member 17. The two axes of the pivot bearings 18 and 19 form a lever arm, as a result whereof the pivoting of the headrest around the first axis of the pivot bearings 18 is achieved, given either a pulling force or a pushing force on the link or rod 20. The end of the rod 20 which lies opposite the pivot bearing 19 is coupled to a transition lever 22, which coupling is set forth in greater detail with regard to FIG. 4**. The lever 22 is mounted for rotation on a bearing journal 23 of the main carrier 16. A support arm or element 24, which is supported against a surface 25 of the base part 15, is also arranged on an extension 22*a* of the lever arm 22 to form a tilt mechanism. As shall be set forth in greater detail later, the main carrier 16 can be tilted vis-a-vis the base part 15 in a defined angular range around the two bearing axes 26 with this adjustment or, respectively, tilt mechanism, as indicated by the arrow.

The bracing member 17 is guided on both sides in a slideway 27 secured to the main carrier 16. To shift the member 17 in the slideway 27 during adjustment of the length of the headrest carrier 7, an electric motor 28 is arranged in the base part 15, and this electric motor 28 drives a toothed belt 29 that is secured with a suitable fastening element 30 to the member 17 and is otherwise guided around a guide roller.

Figure 4:
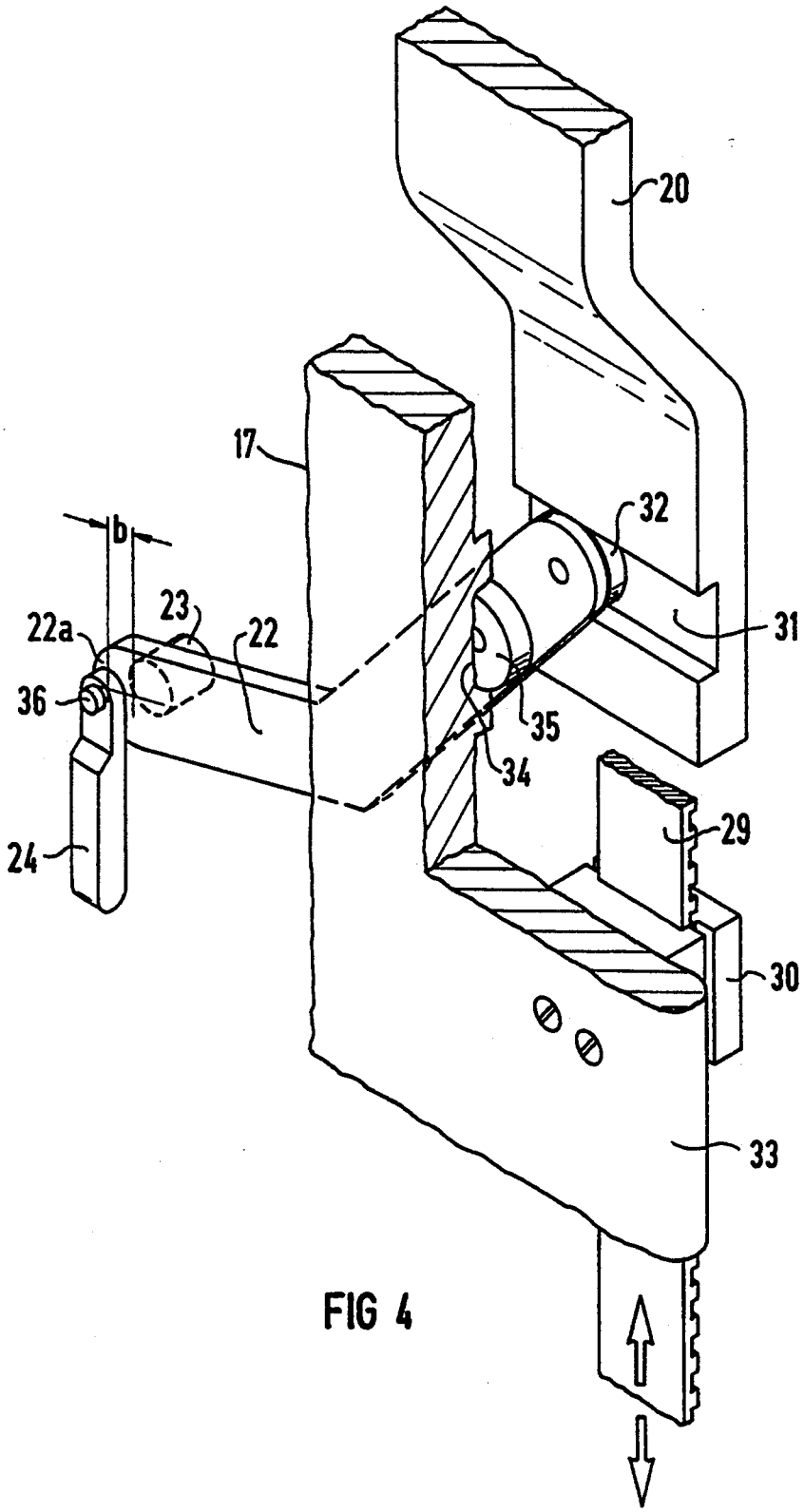
FIG. 4 is a perspective view of a portion of the headrest adjustment mechanism in accordance with the present invention.

A coupling of the link or rod 20 to the translational lever 22 is illustrated in FIG. 4. It may be seen from this Figure that the lower end of the rod or link 20 is provided with a groove 31 which receives a roller 32 mounted for rotation on one end of the lever 22. A second connecting member is formed on the bracing or member 17. This second connecting member includes a portion 33 of the member 17 being provided with a transverse extending slot 34, which receives a second roller 35, which is mounted for rotation on the lever 22. A male member or pin 36 is eccentrically arranged on the extension 22*a* of the translational lever 22 relative to the bearing journal 23. A support element 24 is mounted by this male member 36. The bearing journal 23 and the eccentric member 36 form a spacing b that effects the tilt of the main carrier 16 relative to the base part 15 when the bracing member 17 is motor-adjusted along the cutout 8 of the backrest 2. This is accomplished by the member 24 acting against the ledge or bracket 25 of the element 15.

Synchronously with the combined motion of the bracing member 17, given simultaneous tilting of the headrest in a backward direction, the main carrier 16 is, likewise, inclined or pivoted backward by a specific angular dimension proceeding from a position that was previously slightly inclined forward. This is accomplished by the supporting element 24, which is slightly lifted via the lever arm b between the supporting element 24 and the journal bearing 23 given a tilting motion of the translational lever, due to a contraction or retraction of the member 17 toward the base part 15. As a result, the main carrier is moved backward in the above-mentioned way due to the normal load of the backrest by the patient.

The analogous case applies for the opposite motion, i.e., for the extension of the member 17.

Figure 5:
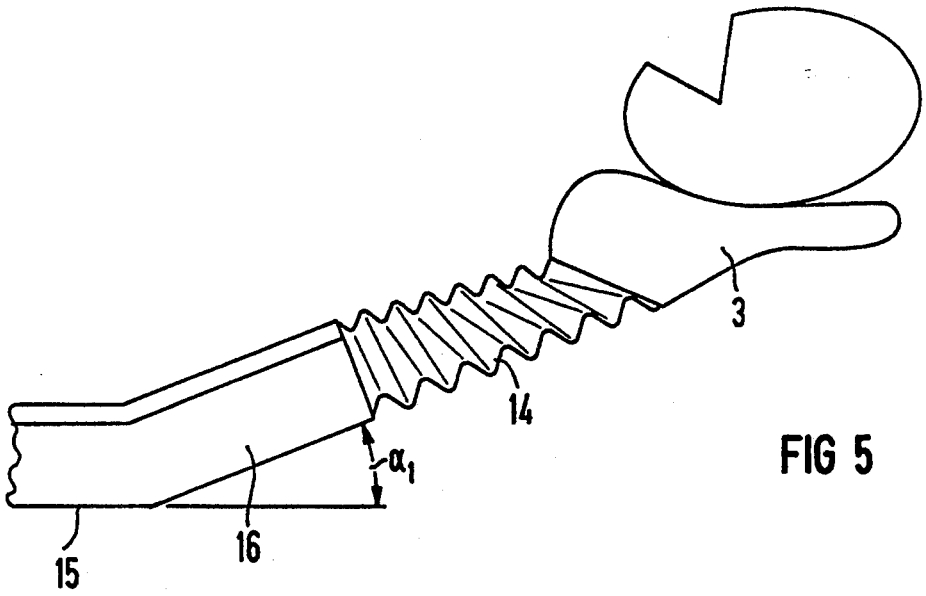
FIG. 5 is a partial side view of the headrest arrangement in accordance with the present invention in a first extreme position.
Figure 6:
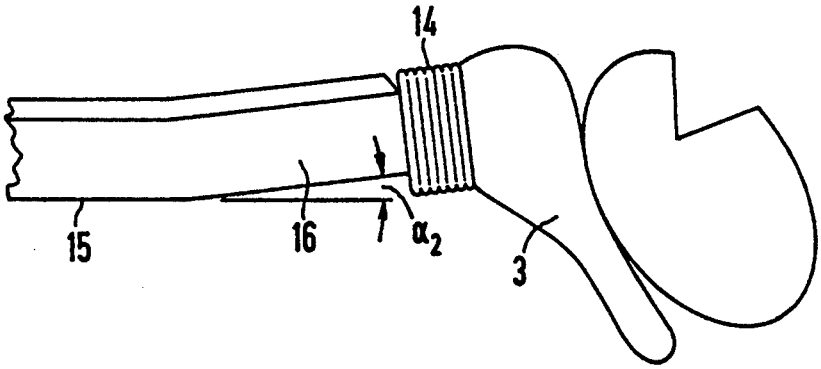
FIG. 6 is a side view similar to FIG. 5 showing the headrest in the other or second extreme position.

The two ultimate positions of the headrest are illustrated in FIGS. 5 and 6. FIG. 5 shows the extended position of the bracing member 17 within the bellows 14, while FIG. 6 shows the withdrawn position of the bracing member 17 within the bellows 14. As may be seen by comparing the two Figures, the main carrier 16 is inclined by an angle $\alpha_1$ between 20° and 25° with respect to a base part 15 when the bracing member 17 is in the extended position (FIG. 5). This extended position is well-suited for a prothetic treatment at the patient seated relaxed or, respectively, lying slightly inclined. When the bracing member is in a retracted position, such as illustrated in FIG. 6, the main carrier 16 is only slightly inclined to the base part 15 by an angle of $\alpha_2$, which is a range of 2° to 6°. As illustrated, when in the extended position, the headrest 3 will assume the position where it is substantially in a horizontal plane, while in the contracted or second position of FIG. 6, the headrest 3 is tilted back.

Although various minor modifications may be suggested by those versed in the art, it should be understood that we wish to embody within the scope of the patent granted hereon all such modifications as reasonably and properly come within the scope of our contribution to the art.

We claim:

1. A dental patient chair comprising a headrest, a backrest, a headrest carrier, first means for adjustably positioning the headrest carrier in said backrest, second means disposed in said headrest carrier for positioning the headrest relative to said headrest carrier, said second means including a bracing member pivotably connected to the headrest on a first axis, a link extending at least over a part of the length of the headrest carrier, said link having a pivotable connection with the headrest on a second axis offset from the first axis, and adjustment means being allocated to the headrest carrier and having a connection to said link for shifting the link to cause pivoting of said headrest on the first axis, the headrest carrier being composed of a lower section, a middle section and an upper section, said lower section containing a base part mounted for longitudinal displacement in the backrest by said first means for adjustably positioning, said middle section containing a middle carrier pivotably connected to the base part and being slightly pivotable in comparison thereto, the upper section containing the bracing member for movement relative thereto, and the backrest having an upwardly open cutout portion with guide means provided on both sides of said cutout, said first means for adjustably positioning including the lower section having means coacting with said guide means.

2. A dental patient chair according to claim 1, wherein the headrest carrier arranged in the backrest cutout is provided with cushions adapted to the exterior contour of the backrest.

3. A dental patient chair according to claim 2, wherein the upper section containing the bracing member is limited by an accordion bellows that covers the extent of the length of the bracing member and forms an exterior contour for the bracing member.

4. A dental patient chair according to claim 1, wherein the headrest is fashioned as a headrest shell containing an angled-off shaped part having a shell-shaped depression as a head support.

5. A dental patient chair according to claim 1, further comprising means including an electric motor drive for adjusting the bracing member relative to the headrest carrier.

6. A dental patient chair according to claim 5, wherein the electric motor drive includes an electric motor driving a toothed belt, which is connected to said bracing member.

7. A dental patient chair comprising a headrest, a backrest, a headrest carrier, first means for adjustably positioning the headrest carrier in said backrest, second means disposed in said headrest carrier for positioning the headrest relative to said headrest carrier, said second means including a bracing member pivotably connected to the headrest on a first axis, a link extending at least over a part of the length of the headrest carrier, said link having a pivotable connection with the headrest on a second axis offset from the first axis, and adjustment means being allocated to the headrest carrier and having a connection to said link for shifting the link to cause pivoting of said headrest on the first axis, the pivotable connection of the link being disposed at an end of said link and including a pivot bearing arranged approximately at the middle of the headrest, said bracing member having a slot-like cutout receiving said link, the connection between the link and adjustment means being at another end of the link and being formed by a connection of said link to a lever mechanism of the adjustment means so that the headrest and a middle carrier of the headrest carrier are adjusted in the sense of a lifting inclination given an outwardly directed motion of the bracing member and are adjusted in a sense of lowering the inclination given an inwardly directed motion of the bracing member.

8. A dental patient chair according to claim 7, wherein the headrest carrier has a base part engaged by the first means for adjustably positioning, said base part being pivotably connected to a main carrier, and said bracing member being mounted for sliding movement in said main carrier.

9. A dental patient chair according to claim 8, wherein the lever mechanism includes a translational lever having one end connected to the link, said lever being connected to the bracing member adjacent said connection to said link, said lever adjacent the other end being mounted for pivotable movement on the main carrier around a pivot axis and adjacent said pivot axis having a support element engaging the base part so that the tilting of the main carrier will occur in view of pivoting of said lever on said pivot axis.

10. A dental patient chair comprising a headrest, a backrest, a headrest carrier, first means for adjustably positioning the headrest carrier in said backrest, second means disposed in said headrest carrier for positioning the headrest relative to said headrest carrier, said second means including a bracing member pivotably connected to the headrest on a first axis and a link extending at least the length of the headrest carrier and being pivotably connected to the headrest at a second axis offset from the first axis, said headrest carrier being composed of a lower section, a middle section and an upper section, said lower section containing a base part mounted for longitudinal displacement in the backrest by said first means for adjustably positioning, said middle section containing a middle carrier pivotably connected to the base part and means for pivoting said middle carrier relative to said base part, the upper section containing the bracing member and means for moving said bracing member relative to the middle section as said middle carrier is pivoted to simultaneously move said link relative to said bracing member thereby pivoting said headrest about said second axis.

* * * * *